US008960436B1

(12) United States Patent
Smith

(10) Patent No.: US 8,960,436 B1
(45) Date of Patent: Feb. 24, 2015

(54) INFLATABLE BOX AND METHOD OF USE THEREOF

(76) Inventor: Jack V. Smith, Arden, NC (US)

( * ) Notice: Subject to any disclaimer, the term of this patent is extended or adjusted under 35 U.S.C. 154(b) by 58 days.

(21) Appl. No.: 13/605,262

(22) Filed: Sep. 6, 2012

Related U.S. Application Data

(62) Division of application No. 09/898,958, filed on Jul. 3, 2001, now Pat. No. 8,281,928.

(51) Int. Cl.
*B65D 81/02* (2006.01)

(52) U.S. Cl.
USPC ..... 206/522; 53/472

(58) Field of Classification Search
USPC ..... 206/522, 524.8, 583, 594; 53/472, 403, 53/79; 383/3
See application file for complete search history.

(56) References Cited

U.S. PATENT DOCUMENTS 3,514,157 A * 5/1970 Geiser ..... 298/22 R
4,905,835 A 3/1990 Pivert et al.
4,966,185 A * 10/1990 Schram ..... 137/223
4,969,312 A 11/1990 Pivert et al.
5,132,130 A * 7/1992 Braeutigam et al. ..... 427/541
5,397,000 A * 3/1995 Holte et al. ..... 206/545
5,588,533 A 12/1996 Farison et al.
5,901,850 A * 5/1999 Jones et al. ..... 206/522
6,076,677 A 6/2000 Pozzo
6,729,110 B2 * 5/2004 Sperry et al. ..... 53/503
2001/0001921 A1 * 5/2001 Sperry et al. ..... 53/403

* cited by examiner

*Primary Examiner* — Jacob K Ackun
*Assistant Examiner* — Jenine Pagan
(74) *Attorney, Agent, or Firm* — Nilay J. Choksi; Smith & Hopen, P.A.

(57) ABSTRACT

An inflatable box and method of use thereof. The inflatable box may be designed in any shape or size and be made up of any rigid material. The box is uniquely designed to allow for a simple one-step process using a box with an integrated inflating tube and bottom liner to expand internally by inflation with a gaseous fluid, thereby three-dimensionally cushioning an article to be shipped. This completely protects the article and removes the need for peanuts, paper or other fillers in boxes used for shipping goods once the box is closed. The box may further include a bleed valve that releases the gaseous fluid if the inflating tube and/or bottom liner are over-inflated.

8 Claims, 10 Drawing Sheets

INFLATABLE BOX AND METHOD OF USE THEREOF

CROSS-REFERENCE TO RELATED APPLICATIONS

This application is a divisional of and claims priority to U.S. patent application Ser. No. 09/898,958, filed Jul. 3, 2001 by the same inventor, entitled "Inflatable Box", the contents of which are hereby incorporated by reference.

BACKGROUND OF THE INVENTION

1. Field of the Invention

This invention relates, generally, to methods of packaging and shipping items. More particularly, it relates to a method of cushioning an item to be shipped.

2. Description of the Prior Art

The use of different types of packaging for shipping articles is well known. Shipped articles can come in all sizes and shapes. These articles can be fragile or hardy (i.e., the article is considered non-fragile). There are several types and forms of packaging, including peanuts, paper, bubble plastic, foam, etc. However, all of the packaging materials mentioned can cause waste disposal and recycling issues.

Different attempts at providing an effective inflatable packaging material and/or system have been made, such as U.S. Pat. Nos. 4,905,835 and 4,969,312 to Pivert, which are limited to a rectangular box with inflatable structures that are inserts into the box, thereby requiring multiple steps for use, from insertion of the inflatable structures to closure of the box. In addition, U.S. Pat. No. 5,588,533 to Farison provides an inflatable cushion through a single inflation valve, which must be inserted into the box with the article. U.S. Pat. No. 6,076,677 to Pozzo is a shipping container and inflatable packaging cushion that must be partially filled, then the article is inserted, and following steps are required.

While the prior art provides protection to the articles within a box, the conventional art suffers from a number of drawbacks.

The inflation, insertion, and closure of the prior art devices all require multiple steps and are not simple, efficient methods of shipping articles or products using an inflatable cushion. The prior art requires tedious methods for inflation. For instance, the prior art requires that certain cushions be inflated before others in a specific sequence, that cushions be inflated before insertion into the box, and complex sequences of events for closure of box flaps and/or self-locking flaps. They require optimal inflation to work properly and finally require multiple cushions to provide adequate protection to the article shipped. The foregoing issues are just some, not all, of the limitations seen in the conventional art.

SUMMARY OF THE INVENTION

The present invention is designed to advance the art of packaging past the drawbacks of the prior art and provide packaging that is simple to use, requires minimal instruction, has the minimum number of parts, and is cost-effective. Another object of the present invention is to provide a method that allows for an easily automated process.

Certain embodiments of the present invention include a method relating to an automated or manual packaging system using an inflatable box of any shape and size. The box is uniquely designed to allow for a simple one-step process using a box with an integrated inflating tube and bottom liner to expand internally by inflation. The inflating tube and bottom liner cushion the article to be shipped three-dimensionally. This completely protects the article and removes the need for peanuts, paper or other fillers in boxes used for shipping goods once the box is closed, thus increasing the safety of using the inflatable devices. This would also lighten the weight of the package considerably.

Correspondingly, another object of the present art is to provide a packaging method that will allow the user to insert the article to be shipped and to close the box prior to inflation. This has several marked advantages over the prior art, such as increasing safety by eliminating the hazard of the inflatable bladder (i.e., air cushion) exploding in the face of the user if over-inflated. This hazard can further be avoided by a bleed valve that will release air when pressure reaches a certain level. This would allow for automated and manual air filling without worry of over-inflating.

In addition, the present invention provides a unique three-dimensional cushion that will fully protect the article being shipped, said cushion capable of being filled from a single valve or point.

It has been found that the foregoing objects of the present invention are accomplished in accordance with this invention by providing a box that has an inflatable cushion attached to the insider liner of the box. The box can also have a collapsible bottom that fills with air, similar to the rest of the cushion (bladder), when the box is closed and the cushion is filled with air. The cushion is designed so that it may be inflated through a single valve or other inflation means that is attached to the outside of the box, thereby allowing for inflation of the device after the box is closed. The cushion may also have a bleed valve integrated into a wall of the box, said bleed valve allowing air to escape in the case of over-inflation.

Once the bottom of the box is closed, the article can be placed into the bottom of the box. The box can then be closed, and the air cushion (air bladder) can be filled externally from the valve attached to the wall of the box to a preset amount. A bleed valve can also be installed into a wall of the box to prevent overfill. This allows for a fully automated inflatable packaging system.

The present invention provides a method of packaging an article using packaging as defined above, said method characterized by the following steps:

a) Closing the bottom flaps of the box;

b) Placing the article to be shipped into the box;

c) Closing the top flaps of the box; and d) Filling the box with air through the valve.

Other aspects and advantages of the present invention appear more clearly from reading the following detailed description of the preferred embodiment of the invention, given by way of example and made with reference to the accompanying drawings, such as the determination of which end of the box is the bottom or top. This is determined by which end of the box is closest to the inflatable bottom part of the cushion.

Certain aspects of the present art can be found in the prior art, but the prior art has failed to overcome its deficiencies and has failed to advance the state of the art in the inflatable packaging industry. Specifically, the current invention provides the user with the unexpected benefits of simplicity, efficiency and safety by placing an article(s) for shipment into a box, closing the box, filling it with air, and shipping it. The prior art appears to teach away from the present invention in that it teaches the use of multiple cushions, multiple steps to closure, inflation of cushions (bladders) before closure of the box, etc. Thus, the current invention advances the state of the art through its novel, useful, and nonobvious apparatus and methodology.

BRIEF DESCRIPTION OF THE DRAWINGS

Other objects, features and advantages of the invention will become obvious from the following detailed description of the invention when taken in conjunction with the accompanying drawings, in which.

DETAILED DESCRIPTION OF THE PREFERRED EMBODIMENT

The present invention will be described more fully with reference to the accompanying drawings, in which the preferred embodiments of the present invention are shown. It is understood from the embodiments that a person skilled in the art may make variations and modifications without departing from the spirit and scope of the invention. Such variations and modifications may include changing the size or shape of a box, the optional addition of a bleed valve, or the addition of a small hand pump integrated into the sidewall of the box.

Figure 1:
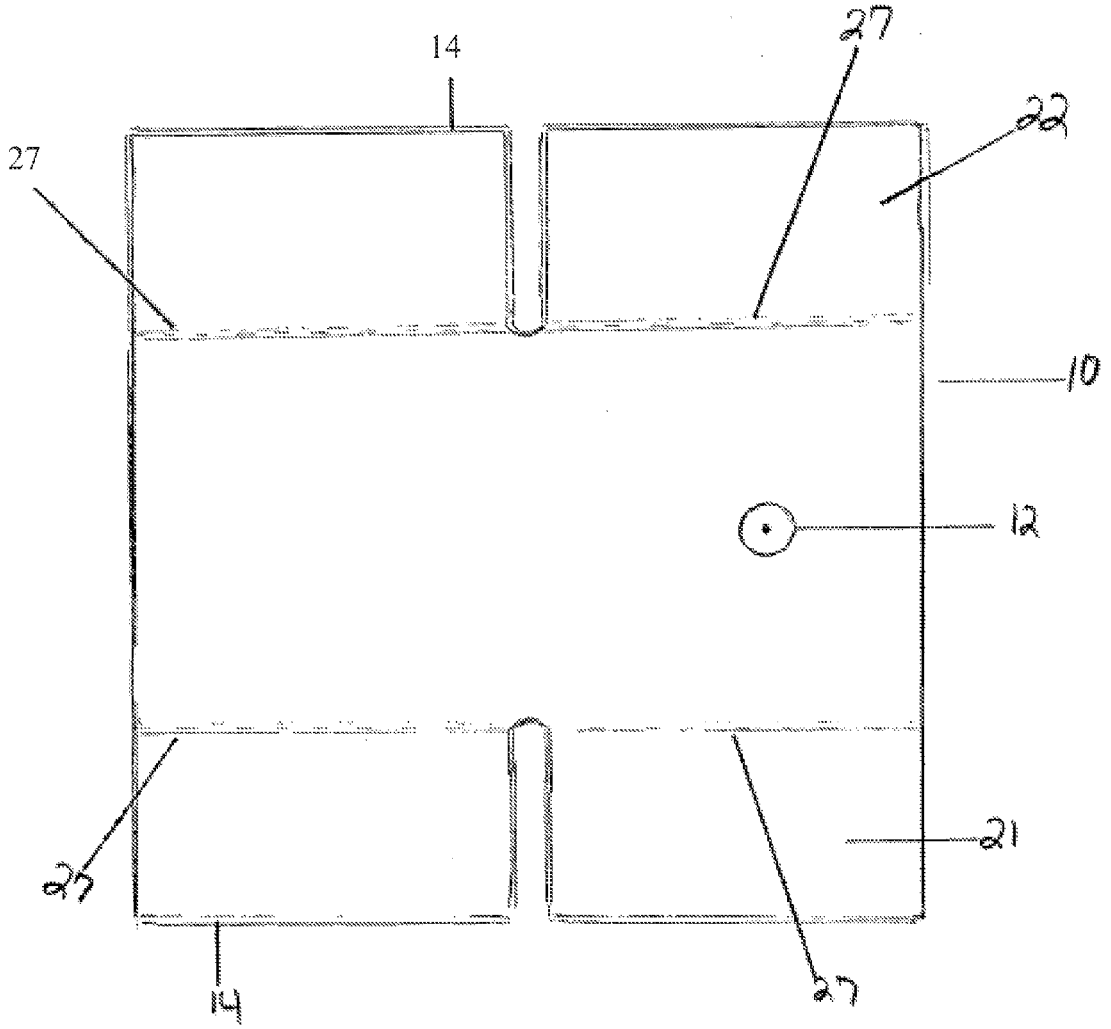
FIG. 1 is a plan view of an embodiment of the inflatable box made in accordance with this invention, shown prior to closure of the bottom and prior to inflation.
Figure 2:
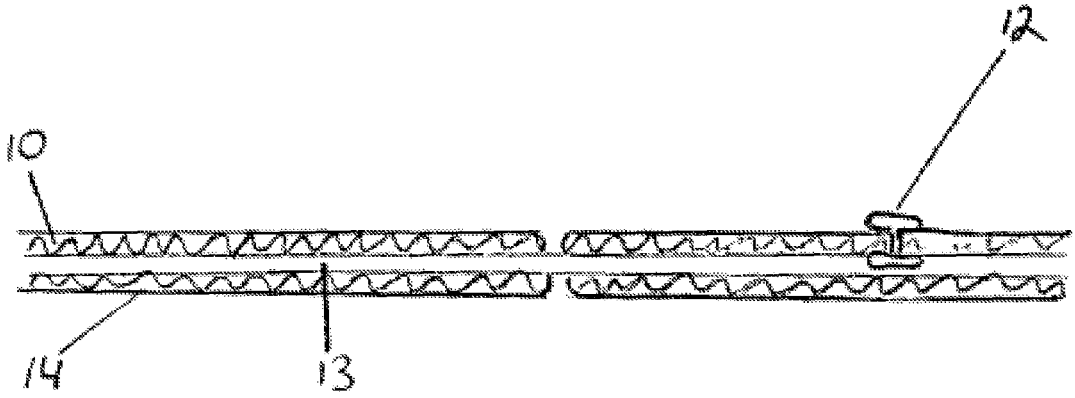
FIG. 2 is a side view of FIG. 1 prior to closure of the bottom flaps and prior to inflation.

Referring now to the drawings and in particular FIGS. 1 and 2, inflatable box 10 as shown is flat, and the bottom flap has not been closed. The plan view of FIG. 1 shows bottom flaps 21, top flaps 22, and folds 27 along the bottom and top of box 10. Also illustrated is air valve 12, which may vary from 1 psi to as much as 100 psi, for example a maximum allowable air pressure of 25 psi. The amount of pressure allowed is directly proportional to the strength of the material used in inflatable air cushion 13 and box 10. Hence, the stronger the materials used, the higher the air pressure that can be allowed. This is of course in reference to extreme levels. In most cases, air pressure as little as about 10 psi to about 25 psi will typically be adequate, and a device as simple as a basketball air pump can be used to achieve this pressure. The material used in inflatable cushion 13 of FIG. 2 can range from rubber to plastic of any types or other suitable material capable of holding air and conforming to the shape of the article(s) shipped in box 10. Box 10 of FIGS. 1 and 2 can be made of cardboard, paper, plastic, wood, corrugated paper 14, or other suitable materials.

Figure 3:
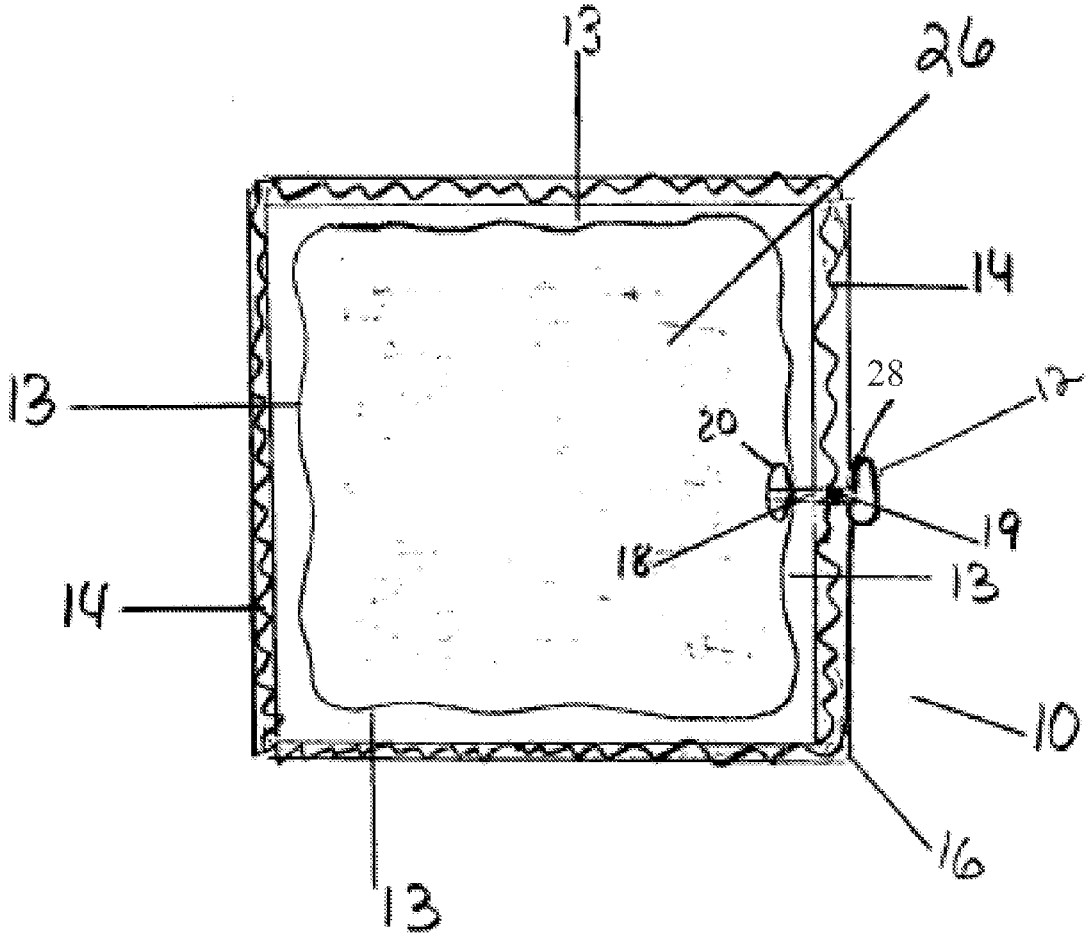
FIG. 3 is a side view of the box in FIG. 1 folded out prior to closure of the bottom flaps, allowing a view of the transparent bladder bottom at the bottom of the box.
Figure 4:
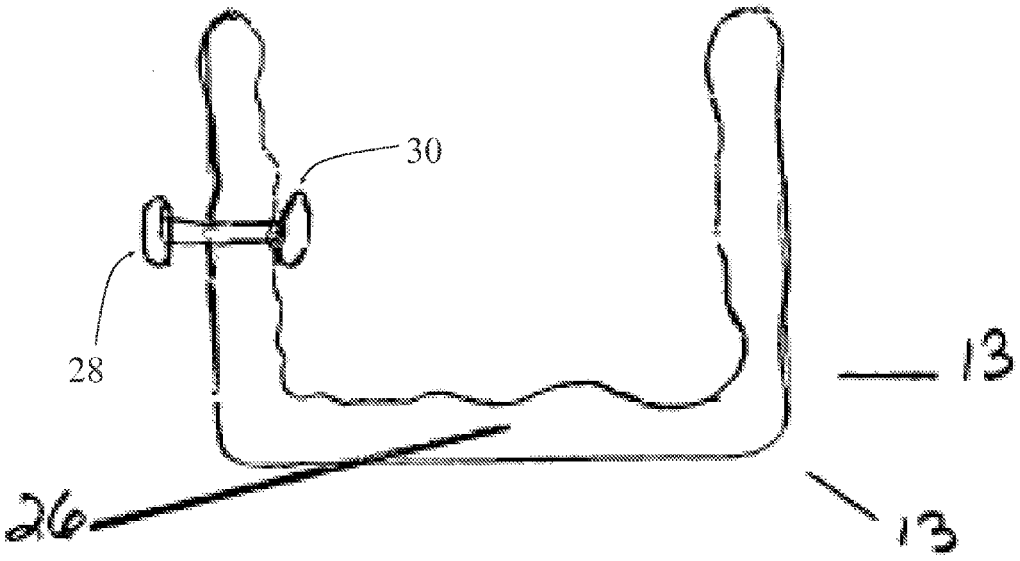
FIG. 4 is a cross sectional side view of the inflatable cushion if it were not attached to the box.
Figure 5:
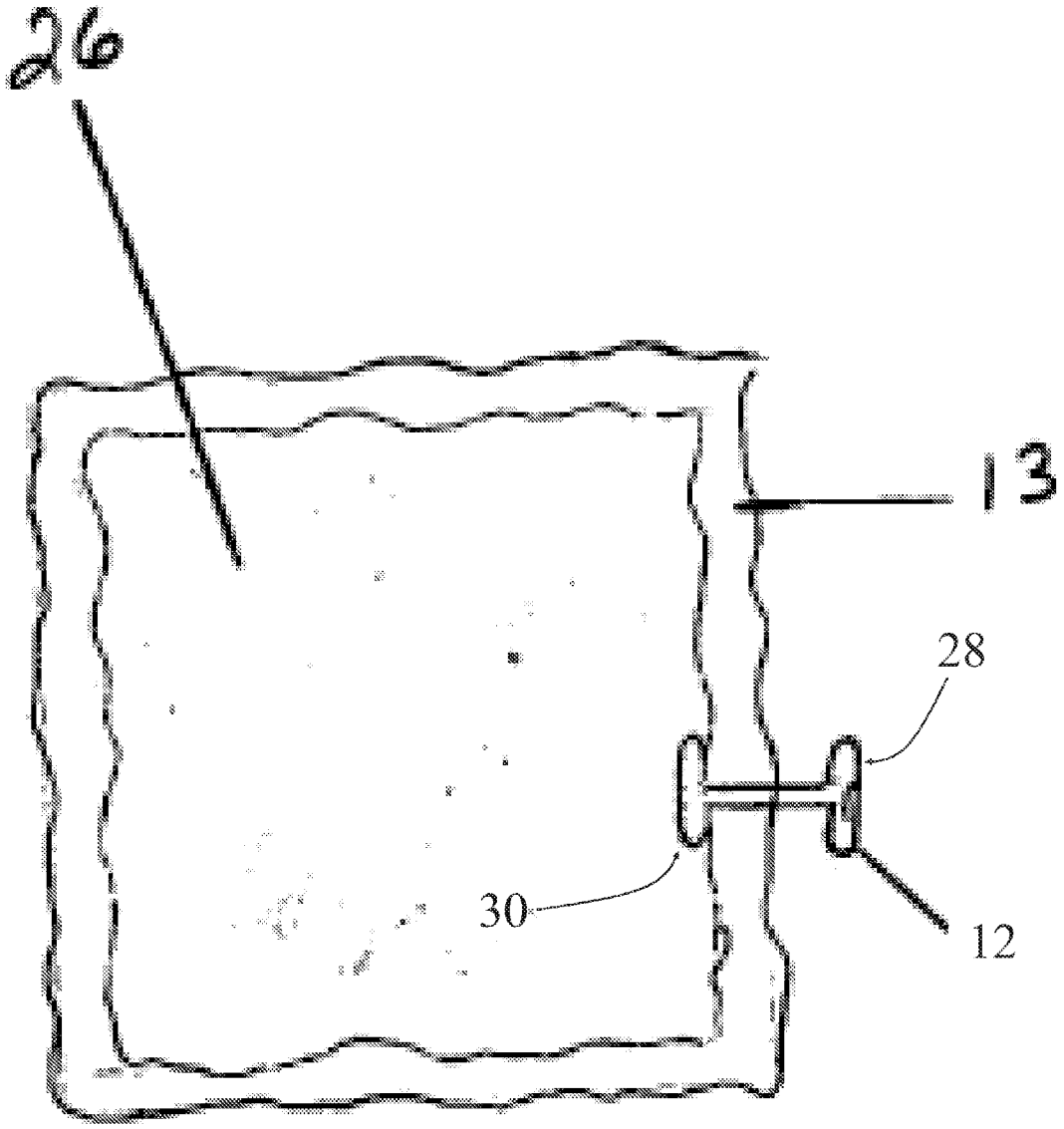
FIG. 5 is a top view of the inflatable cushion if it were not attached to the box.
Figure 6:
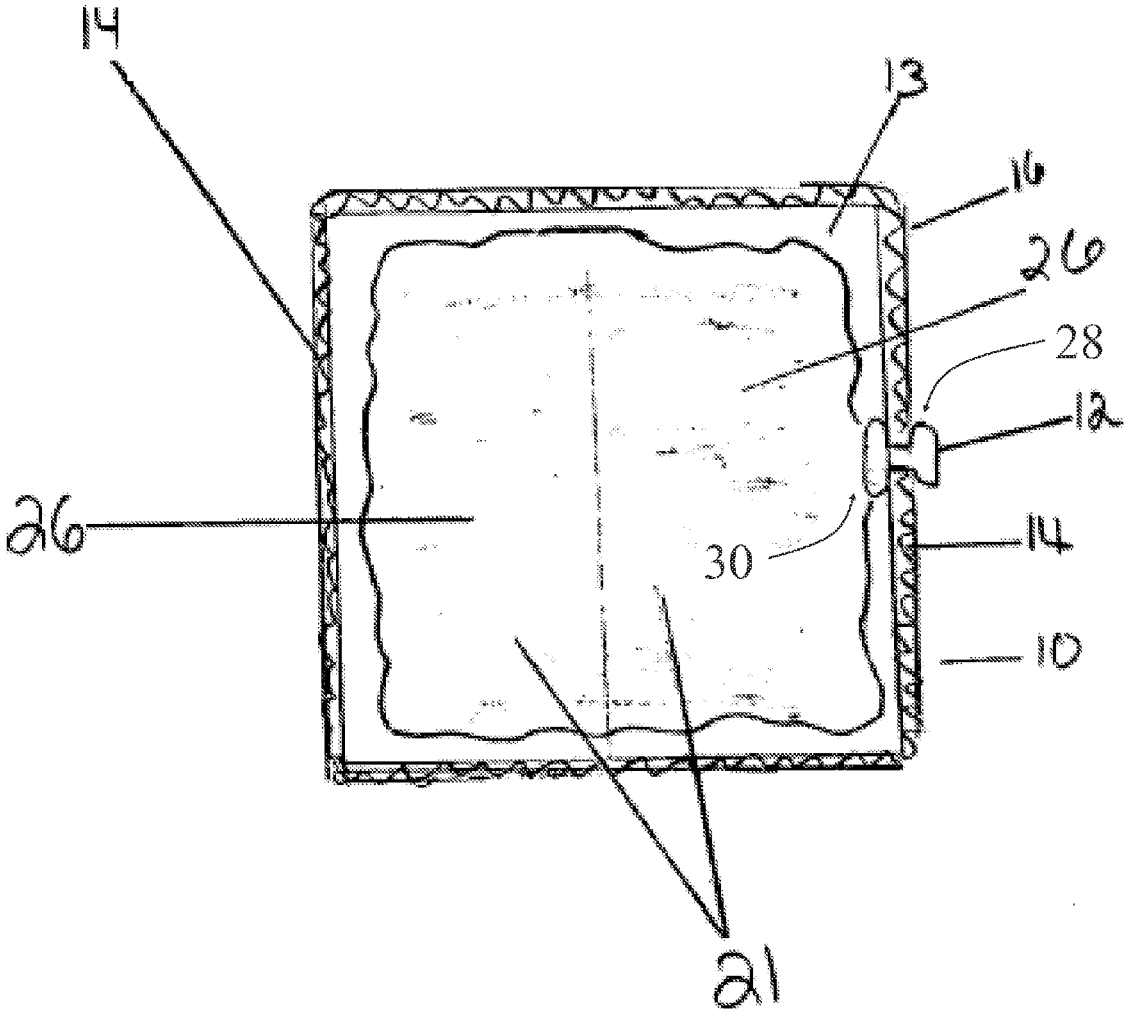
FIG. 6 is a top view of FIG. 3 with the bottom flaps closed.

As shown in FIG. 3, transparent inflatable cushion (bladder) 13 is attached to inside 17 of four sides of box 10 prior to use, by use of an adhesive, such as glue, paste, or other suitable material or device. The bottom of inflatable cushion 26, which can be seen in FIG. 3, is visible. Valve 12, as illustrated in FIG. 3, is in fluid contact or communication with bladder 13 and with outside 16 of box 10 via hollow tube (lumen) 18 connecting the outside of box 10 and the inside of inflatable cushion 13. Valve 12 can be held in place using the lip of inlet port 28 of valve 12, where the lip will hold the valve to outside 16 of box 10 and the inside of inflatable cushion 13. Septum 19 may be present in the middle of valve 12 to allow needle 24 to pass through and to provide a seal when needle 24 is removed. The mechanics and illustration for valve 12 and how it is connected can be changed without leaving the spirit and scope of the invention. FIGS. 4 and 5 illustrate what bladder 13 would look like if it were not connected, bonded to, or otherwise attached to box 10. FIG. 6 shows an inside view of box 10 with bottom flaps 21 closed.

Figure 7:
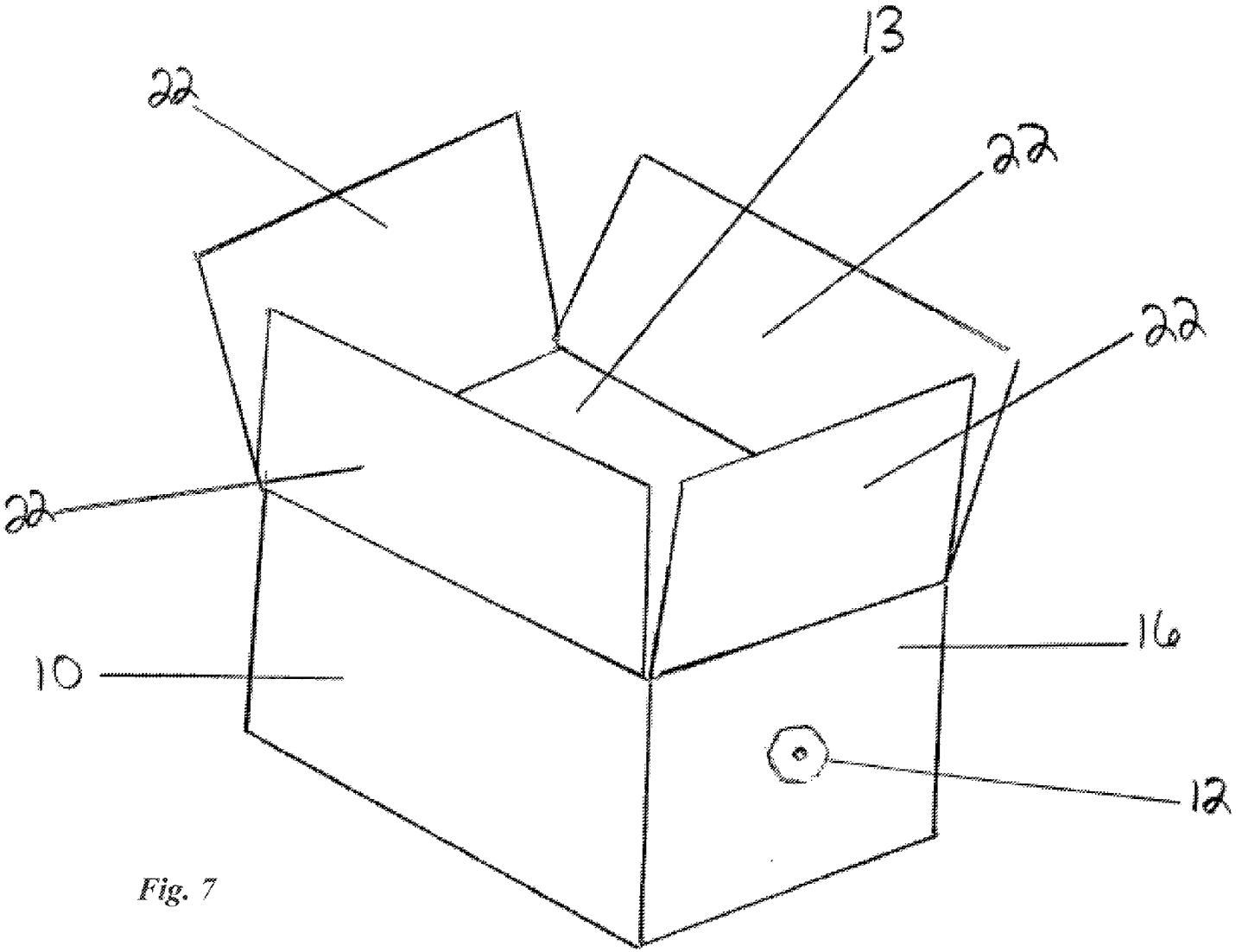
FIG. 7 is a plan view of the box in FIG. 1 with the bottom flaps closed, exhibiting the air valve.
Figure 8:
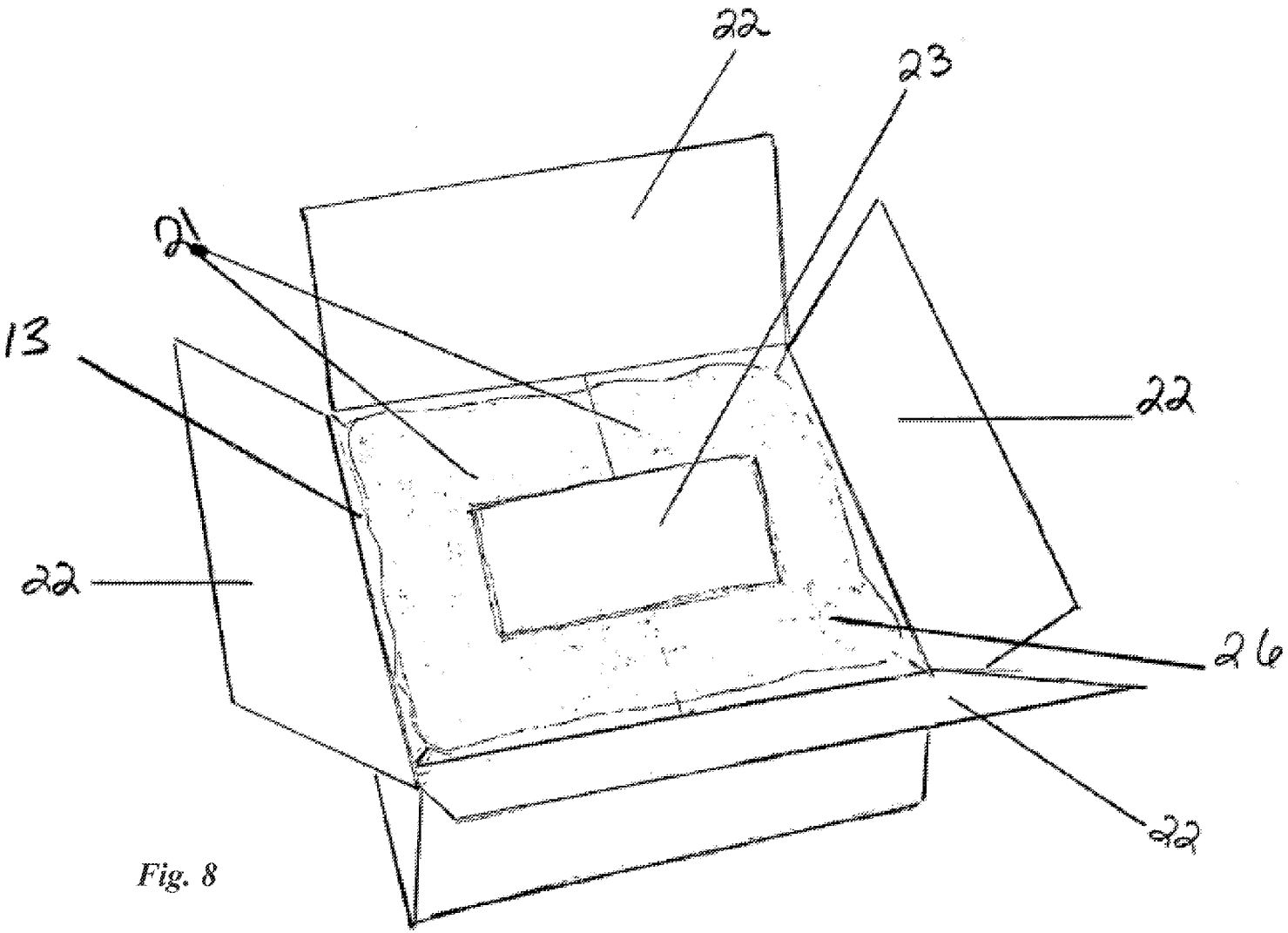
FIG. 8 is a plan view of the inside of the box in FIG. 1 with the bottom flaps closed and an article placed in the bottom of the box.
Figure 9:
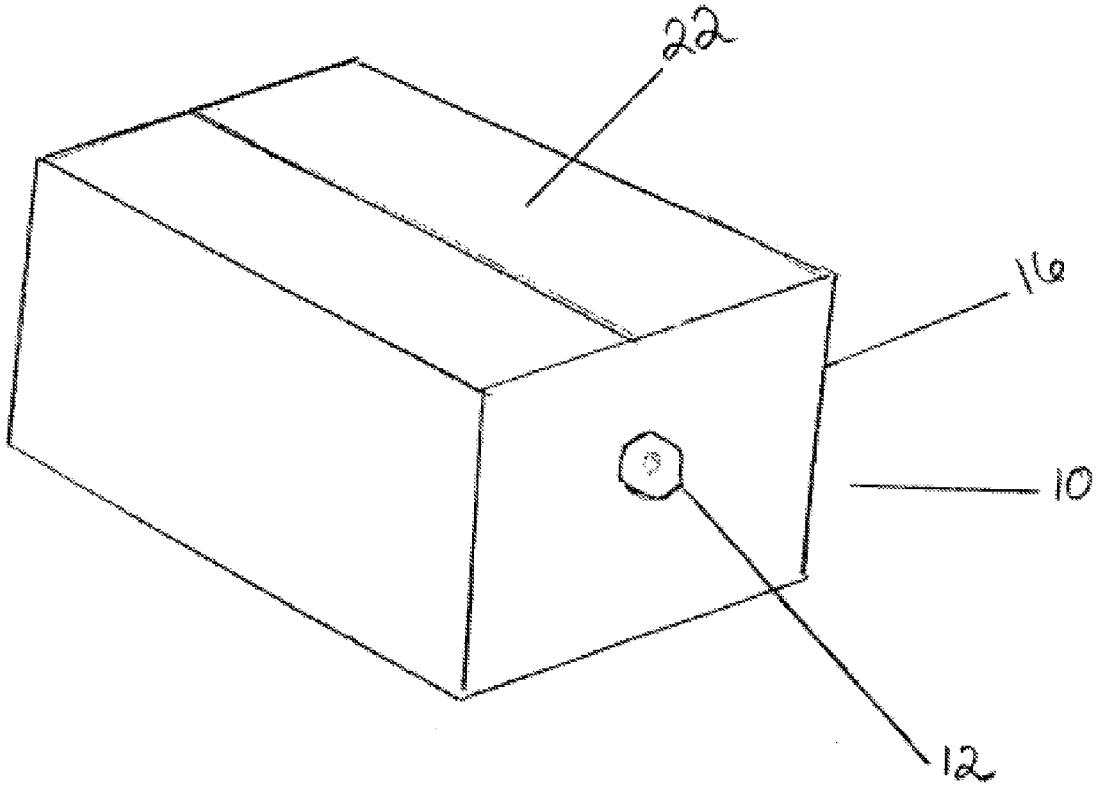
FIG. 9 is a plan view of the box in FIG. 1 with both bottom and top flaps closed.
Figure 10:
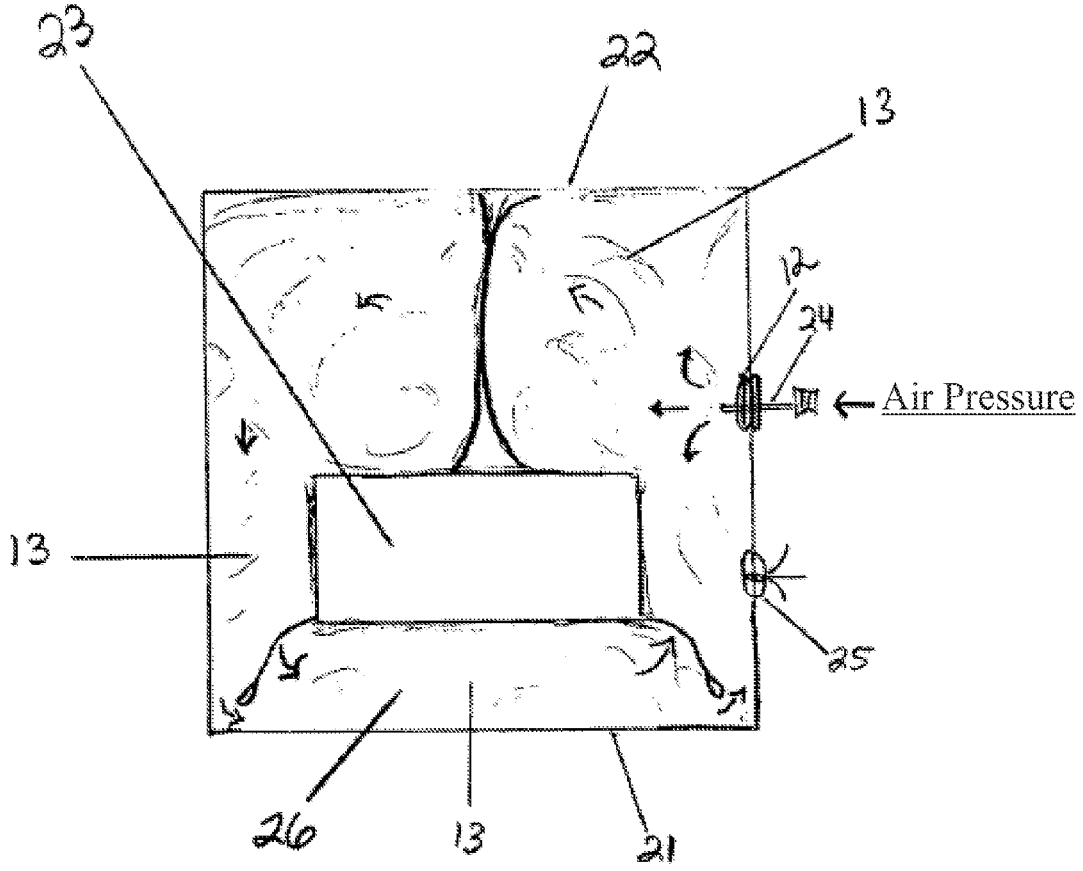
FIG. 10 is a side transparent view of the inside of the box in FIG. 1 exhibiting both the optional bleed valve and the bladder being inflated with a needle through the air valve on the side of the box.

A plan view of box 10 is shown in FIG. 7 with top flaps 22 of box 10 opened. FIG. 8 is an inside plan view of the box with article 23 placed on the bottom of box 10. FIG. 9 shows a plan view of box 10 with top flaps 22 closed, such that box 10 is ready for inflation of bladder 13 prior to shipment. FIG. 10 is a transparent side view of box 10 illustrating bladder 14 inside of box 10 upon inflation. The bottom and sides of inflatable cushion 13 begin to fill with air or other gaseous fluid, providing support to article 23 from all sides. Inflatable cushion 13 inflates to provide protection on the bottom, top and sides of article 23 within the interior of box 10. Needle 24, as shown, penetrates valve 12 and cushion 13, allowing the gaseous fluid under pressure to enter. Also illustrated in FIG. 10 is optional bleed valve 25, which allows gaseous fluid to escape of box 10 if box 10 is overfilled or over-inflated with the gaseous fluid.

A method of inflatable packing or cushioning article 23 to be shipped is also contemplated by the current invention. The basic steps are as follows:

a) Closing the bottom flaps of the box;

b) Placing the article to be shipped into the box;

c) Closing the top flaps of the box;

d) Filling the box with air through the valve.

The simplicity and novelty of the present invention has not been taught in the conventional art. It is contemplated that packing of box 10 and inflation of bladder 13, in particular, can be automated. For example, an assembly line may have boxes traversing a conveyor belt with the bottom of the boxes closed, leaving the top open. Then an article can simply be placed inside of the box through automated means (via a machine) or manual means (via an operator). Then the box would continue traversing the conveyor belt to an air filling station where an automated or manual means could be utilized to inflate the box to the desired pressure. The current invention provides an apparatus and methodology that significantly improves cost efficiency within the packaging industry, for example in shipping time, weight, and labor.

To further explain the inflatable box, it comprises an inflatable box made up of a rigid material or the like, with an attached inner inflatable cushion having a bottom that is attached to the inside walls of the box. The inflatable cushion can be inflated through a valve, wherein the box includes bottom closing flaps (top and bottom), said inflatable cushion covering the inside walls and the optionally the bottom of the box. The inflatable box further includes a valve connecting the outside of the box and the inside of the cushion through a hollow lumen, thereby allowing air or other gaseous fluid under pressure to pass therethrough, from the outside of the box to the inside of the inflatable cushion.

The current invention further teaches a method of packaging where an article can be packaged using an inflatable box comprising an outer rigid cardboard material or the like with bottom and top flaps, and a flexible inflatable cushion that is attached to the inside walls of the box. Sidewalls interconnect the top and bottom walls, such that the box can be opened and closed so that the article can be introduced into or removed from the box. The inflatable cushion is affixed within the hollow interior of the box. An opening is formed in a wall of the box, and a normally closed valve is positioned in sealing engagement with the opening. The valve includes inlet port 28. In let port 28 is disposed external to the box and is adapted to be connected to a source of gaseous fluid under pressure. The valve further includes outlet port 30, which is disposed within the hollow interior of the box. Outlet port 30 or inlet port 28 is in fluid communication with the inflatable cushion so that the inflatable cushion is inflated when the source of gaseous fluid is connected to the inlet port and actuated. Optionally, an additional inflatable cushion can be disposed in the hollow interior of the box in cooperative relation to the first inflatable cushion to provide an enhanced cushion in the box. Optionally, the inflatable bladder can be inflated after the article has been inserted into the hollow interior of the box, and the inflatable bladder can be deflated prior to removal of the article from the box. Optionally, an additional opening can be formed in a wall of the box, and in that hole would be positioned a bleed valve in sealing engagement with the hole. The bleed valve would be in fluid communication with the inflatable cushion so that the bleed valve can release the gaseous fluid if the inflatable cushion is over-inflated. Optionally, when the inflatable cushion is affixed within the hollow interior of the box, the inflatable cushion is affixed to the bottom wall and sidewalls of the box. The inflatable box can be filled with air or other suitable gas, as desired by a user.

The invention has been described in detail with particular reference to a preferred embodiment and the operation thereof, and it is understood that variations, modifications, and substitution of equivalent means can be effected and still remain within the spirit and scope of the invention. All such modifications and variations are to be included within the scope of the invention as defined in the appended claims.

What is claimed is:

1. A method for cushioning a package for an item being shipped, comprising the steps of:

providing a box having a hollow interior defined by a top wall, a bottom wall, and sidewalls interconnecting said top and bottom walls;

adapting said box to be opened and closed so that said item may be introduced into or removed from said box;

affixing an inflatable bladder within said hollow interior of said box, said inflatable bladder including a bottom portion and side portions affixed to said sidewalls of said box, said bottom portion and side portions of said inflatable bladder integrated and in open communication with each other to form a single inflatable bladder that supports all sides of said item, said side portions of said inflatable bladder extending from said bottom portion to form an interior space having an open top when in a first deflated position, said side portions being substantially normal to said bottom portion and extending substantially along a length of said sidewalls of said box in said first deflated position;

forming an opening in a wall of said box;

positioning a valve in sealing engagement with said opening;

disposing an inlet port of said valve external to said box;

adapting said inlet port to be connected to a source of gaseous fluid under pressure;

providing fluid communication between said inlet port and said inflatable bladder so that an entirety of said inflatable bladder is inflated when said source of gaseous fluid under pressure is connected to said inlet port and actuated external to said box, said inflatable bladder having a second inflated position when said box is in a closed position, said bottom portion of said inflatable bladder cushioning the bottom of said item in said second inflated position, said side portions of said inflatable bladder engulfing the sides and top of said item being shipped by filling in said open top when in said second inflated position.

2. The method of claim 1, further comprising the step of:

positioning said item within said hollow interior of said box;

connecting said source of gaseous fluid to said inlet port;

actuating said source of gaseous fluid to inflate said inflatable bladder with said gaseous fluid, said inflated inflatable bladder serving as a cushion for said item during shipping.

3. The method of claim 1, further comprising the steps of:

inflating said inflatable bladder after said item has been inserted into said hollow interior of said box; and deflating said inflatable bladder prior to removal of said item from said box.

4. The method of claim 1, further comprising the step of:

forming an additional opening in a wall of said box;

positioning a bleed valve in sealing engagement with said additional opening; and providing fluid communication between said bleed valve and said inflatable bladder so that said bleed valve can release said gaseous fluid if said inflatable bladder is over-inflated.

5. The method of claim 1, further comprising:

said step of affixing said inflatable bladder within said hollow interior of said box includes affixing said inflatable bladder along said bottom wall and said sidewalls of said box.

6. The method of claim 1, further comprising:

said box formed of a rigid material.

7. The method of claim 1, further comprising:

said box formed of a semi-rigid material.

8. The method of claim 1, further comprising:

coupling a hand pump to said valve, said hand pump being in fluid connection with said inflatable bladder.

* * * * *